United States Patent [19]

Hartmann

[11] Patent Number: 4,504,221

[45] Date of Patent: Mar. 12, 1985

[54] TUNNEL OVEN AND WAGON

[75] Inventor: Michel Hartmann, Chalonvillars, France

[73] Assignee: Entreprise Hartmann Pere et Fils, Belfort, France

[21] Appl. No.: 466,315

[22] Filed: Feb. 14, 1983

[30] Foreign Application Priority Data

Feb. 12, 1982 [FR] France ..... 82 02294

[51] Int. Cl.[3] ..... F27B 9/26; F27D 3/12; F27D 1/18

[52] U.S. Cl. ..... 432/137; 432/241; 432/242

[58] Field of Search ..... 432/137, 241, 242

[56] References Cited

U.S. PATENT DOCUMENTS

| | | | |
|---|---|---|---|
| 1,105,729 | 8/1914 | Waterhouse et al. | 432/137 |
| 1,698,835 | 1/1929 | Weiser | 432/241 |
| 3,867,093 | 2/1975 | Huttermann | 432/241 |

FOREIGN PATENT DOCUMENTS

| | | | |
|---|---|---|---|
| 2737549 | 3/1979 | Fed. Rep. of Germany | 432/242 |

*Primary Examiner*—John J. Camby

*Attorney, Agent, or Firm*—A. W. Breiner

[57] ABSTRACT

There is disclosed a tunnel oven which comprises a base, a guide provided on the base to guide the movement through the oven of wagons bearing product to be treated in the oven, side walls connected to the base and a roof connected to the upper ends of the side walls in order to define a treatment chamber. Each wagon comprises a base for supporting product to be treated, and wheels supporting the wagon base and engageable with the guide. The base of the oven includes a trough containing a liquid, and each wagon has a skirt depending from the wagon base which defines an under chamber below the wagon base and which has its lower edge continuously immersed in the liquid as the wagon moves through the treatment chamber. A train of wagons can thus pass through the oven, with the under chamber of each wagon sealed-off from the oven treatment chamber, whereby the wagon bases, or product carried thereby, effectively form a lower face of the treatment chamber. The skirts depending from each wagon base are formed by metal blades which extend downwardly from the longitudinal and transverse end walls of the wagon bases.

8 Claims, 2 Drawing Figures

TUNNEL OVEN AND WAGON

The present invention relates to a sealing device for a tunnel oven, and aims more particularly at a device for the sealed closure of the lower face (or base) of the firing or drying chamber of the tunnel oven, as well as the wagons and tunnel ovens arranged so as to allow these sealing devices to be received.

It is known that in tunnel ovens frequently used, especially in brick works and tile works, for the firing or drying of the products to be treated, such as bricks and tiles, these products are carried by wagons or trucks which form a train, and are successively charged by being connected to the part of the train entering the rectilinear tunnel oven, at one of its ends, and by pushing the wagons already in this latter until the wagon which is at the other end or at the exit of the oven is sent out, the wagon leaving the oven being unloaded then brought back to the point of departure by a path parallel to the tunnel oven.

Given the very large dimensions of these tunnel ovens and the high temperature at which they operate, the quantities of energy consumed are very large. The energy losses must therefore be reduced to a minimum, on the one hand because of the restrictions of energy supplies and on the other hand because the larger losses are due to gas currents between the external atmosphere and the inside of the baking chamber. These currents not only create losses but above all they disturb the homogeneity of the temperature inside the tunnel oven and reduce the quality of the products baked.

The sealing of the tunnel ovens in the upper part and on the sides hardly causes any problems given that they are fixed structures. On the other hand, the sealing at the entrance and exit and the sealing on the lower face of the baking chamber cause problems. The sealing at the entrance and exit can be achieved in various known manners, notably by using air locks.

The invention relates to the sealing of the firing chamber of a tunnel oven on its lower face, i.e. near the ground. In fact, as the wagons are carried by wheels, it is necessary that these wheels can roll on a path without being subjected to too high a temperature. The wagons themselves ensure the closure of the largest part of the lower face or base of the firing chamber, but the sealing must be ensured on the one hand between the side walls of the firing chamber and the wagons, and on the other hand between the wagons themselves.

It is known that given the high temperatures used for firing products such as bricks and tiles, the walls of the ovens and the wagons undergo deformations in the course of use. Prolonged use of the refractory linings causes the deformation of the latter and the gradients of temperature created in the wagons also cause deformations of the latter. It is therefore essential that the sealing devices used allow compensation for these deformations, i.e. have a relatively large working area.

To ensure the sealing between each wagon and the side walls of the firing chamber, constituted by the longitudinal walls of the tunnel oven, it has already been proposed either to provide, in the side walls of refractory linings disposed on the wagon plates, carried by frames provided with wheels for their displacement on rails in the tunnel oven, at least one part entering (towards the longitudinal axis of the tunnel oven) and/or at least one part leaving (towards the adjacent longitudinal wall of the oven) co-operating with at least one uncoupled part towards the interior of the oven and/or at least one uncoupled part towards the exterior of the oven, respectively of the longitudinal adjacent walls of the oven, to define between them baffles reducing the radiation of heat from the oven towards the bottom of the wagons, as shown in FIG. 1 of French Pat. No. 2 470 351, or to provide a sealed joint round the lower edge of a mechanical element such as a skirt, passing under the side edges of the framework of the wagons, or a metal wall, substantially vertical, a so-called sheet metal blade, carried by the side edges of the wagons, so that this lower edge is constantly immersed in a bath of solid material, like sand, as is proposed in French Pat. No. 934 099 (FIGS. 1 to 4) and No. 1 440 132 (FIG. 4), or of a liquid material, preferably heat-carrying, such as water or a mineral oil, this solid or liquid material being contained in channels or troughs extending along the whole length of the tunnel oven inside the latter, on both sides of the path on which the wagons move, and parallel to this path, or to provide both lateral baffles between the longitudinal walls of the oven and the wagons, and a sealed joint, for example hydraulic, around the lower edge of the lateral flanges of the wagons, so that the air arriving from one end of the tunnel oven, below the wagons, can not rise up again between the wagons and the side walls of the oven, towards the firing or drying chamber of the oven.

To ensure the sealing between the wagons, i.e. between the transverse faces opposite two consecutive wagons of the train, it has already been proposed either to provide, in the transverse walls of refractory linings disposed on the plates of the wagons, which transverse walls can not come into contact with one another by virtue of the fragility of the refractory linings which would be damaged by the respective thrusts exerted by each wagon on the preceding one, at least one part axially uncoupled towards one end of the tunnel oven and/or at least one part axially uncoupled towards the other end of the tunnel oven, so that the one or more than one uncoupled part of a transverse wall of a wagon and the one or more than one uncoupled part of the transverse wall opposite the corresponding adjacent wagon of the train define a baffle so as to reduce the radiation towards the duct of the heat from the oven, as proposed in French Pat. No. 2 470 351 (FIG. 2), or to provide, between the transverse edges of two consecutive wagons of the train, a sealed joint, extending along the whole width of the wagons, and constituted by flexible cushions, in asbestos or a similar material, as proposed in French Pat. No. 934 099, or of two elements, the rigid one of which, seen in the form of an open shape (C-shaped) in which is disposed a flexible sealing lining, is carried by the transverse edge of a wagon, whilst the other element, carried by the transverse edge opposite the corresponding adjacent wagon, is in the form of a projecting element (ribbing with rounded edge in French Pat. No. 1 440 132, projection in triangular section and top directed towards the shape with the flexible sealed lining in French Pat. No. 2 470 351) so that the projecting element engages in the profiled shape and compresses the flexible sealing lining, when the two wagons are coupled to one another, or by an inflatable hydraulic joint, the area of expansion of which is sufficiently large for the deformations of the wagons to be compensated, and which is mounted on at least one of the transverse walls of each wagon to ensure the sealing between the wall on which it is mounted and the wall opposite the adjacent wagon, this inflatable joint being fed by a hydraulic circuit mounted partly at least on the wagons, or to provide both transverse baffles between wagons and transverse sealing joints, the first protecting the second against radiation and, possibly, direct contact of flames, as proposed in French Pat. No. 2 470 351 and No. 1 440 132, where the elements of the joint form a baffle by themselves, so that the air arriving from one end of the tunnel oven below the wagons can not go back up between the wagons towards the firing or drying chamber of the oven.

So as to ensure connection between the longitudinal sealing obtained by the co-operation of the sheet metal blades and the side channels or troughs of sand or liquid, and the transverse sealing, obtained by flexible or inflatable cushions or sealing joints carried by the transverse walls of the wagons, these cushions or joints extend, on the side of each lateral wall of the tunnel oven, by a part, approximately of the same section, which descends between the vertical edges opposite the side sheet metal blades of two consecutive wagons, and right below the level of the sand or the liquid in the troughs.

These embodiments have a number of drawbacks, due to the fact that the elements constituting the cushions or sealing joints have poor resistance to wear and undergo considerable thermal and mechanical stresses which consequently incurs high expenses in maintenance and upkeep because of the frequent replacing of the joints, due to the complexity of the structures having to be provided, as much for the manufacture of the joints, when they are inflatable, for example, as for the construction of the connections between the two sealings, for example by means of vertical blades coming into contact with vertical sealing linings in the U-shaped elements and surrounded by supplementary U-shaped elements having dimensions and occupying positions that are relatively precise, as is provided in French Pat. No. 1 440 132, which consequently increases the cost of manufacture and of equipping the wagons, especially if the baffles have to be defined between their opposite transverse faces.

With the present invention it is proposed to remedy these disadvantages, by means of a simple structure, which allows a continuous hydraulic sealing joint to be made round each of the wagons, so as to prevent any circulation of air underneath the wagons.

To this end, the sealing device for the tunnel oven, in particular for the tight closure of the lower face (or base) of the firing or drying chamber of a tunnel oven, that at least one support wagon of products to be treated (to be fired or to be dried), but preferably several, forming a train, is or are destined to cross, each wagon comprising a framework having lateral walls, coming into a position substantially parallel to the sealed side walls of the oven, which define laterally the firing or drying chamber, when the wagon is in the tunnel oven, transverse walls integral with which are thrust elements of the wagons, for thrusting one another, and possibly coupling elements, said framework being mounted on wheels allowing the displacement of the wagon on a path crossing the tunnel oven and itself carrying a plate, covered with refractory linings on which are disposed the products to be treated, and defining partly the lower face of the baking or drying chamber, and sheet metal blades extending in substantially vertical directions, are integral with the side walls of the frame and pass under the latter, is characterised in that it also comprises sheet metal blades integral with the transverse walls of each wagon, which sheet metal blades pass under the framework in a substantially vertical direction and are connected to the sheet metal blades of the side walls of the wagons so as to constitute a continuous skirt surrounding the frame of each wagon, and the height of which is such that its lower edge is constantly immersed in a heat-carrying liquid contained in a trough made in the tunnel oven, whatever the level of this liquid in the trough, taking into account the differences in pressure which can exist between the central part of the oven and the end parts of this latter, so as to constitute a continuous hydraulic sealing joint around each wagon which is in the oven.

Preferably a vent hole is provided in one of the lateral sheet metal blades of the continuous skirt of each wagon, above the maximum level reached by the liquid, as the wagon passes into the oven, to allow the equilibrium of the pressures between the inside of the oven and the air chamber defined by the continuous skirt under the wagon.

The invention also has as its object a tunnel oven comprising a sealed roof resting on sealed side walls that are substantially vertical, and crossed here and there by a path on which trains of wagons loaded with products to be treated in the oven can be moved, and is characterised in that a trough, formed in the oven, contains a heat-carrying liquid, the level of which is such that the lower edge of a continuous skirt, surrounding each wagon crossing the oven is constantly immersed in this liquid, whatever the differences in pressure obtaining between the central part of the oven and its end parts.

Preferably the tunnel oven of the invention comprises an approach to the trough and an exit ramp from the trough, on which extends the travel path of the wagons crossing the oven, this path being for example a railway, the rails of which extend on the bottom of the trough.

The final object of the invention is a wagon intended to support products to be treated in a tunnel oven, said wagon comprising a frame, the side walls of which carry sheet metal blades extending in a substantially vertical direction and passing under the frame, and the transverse walls of which carry thrust elements of the wagons for thrusting one another, and possibly coupling elements for coupling the wagons to one another, said frame being mounted on wheels, to allow the displacement of the wagon and itself carrying a plate covered with refractory linings intended to receive the products to be treated and is characterised in that it also comprises sheet metal blades extending in a substantially vertical direction, passing under the frame and carried by the transverse walls of the latter, the sheet metal blades of the transverse walls being joined to the sheet metal blades of the side walls so as to constitute a continuous skirt surrounding the frame of the wagon, at a height sufficient for the lower edge of the skirt to be constantly immersed in the heat-carrying liquid contained in the trough of a tunnel oven of the invention.

Preferably a vent hole is made, above the maximum level that can be reached by the liquid in the trough, in one of the sheet metal blades of the side walls of the wagon.

DESCRIPTION OF PREFERRED EMBODIMENT

Figure 1:
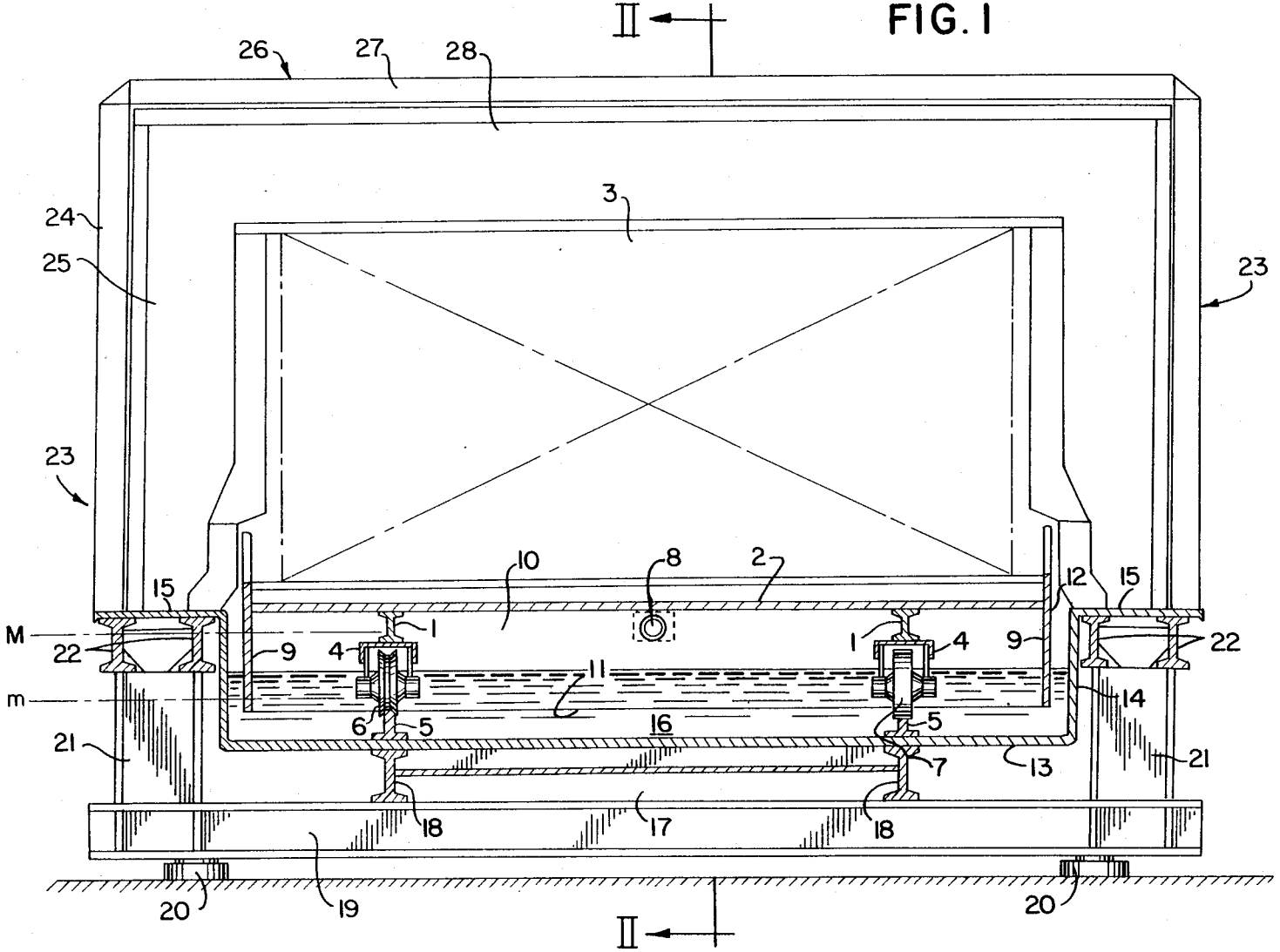
FIG. 1 is a schematic view in cross-section of one embodiment of wagon according to the invention to be used in a tunnel oven of the invention.

In the embodiment of wagon, and the embodiment of tunnel oven, which are shown in the drawings, and which will be described in more detail below with reference to the drawings, the tunnel oven comprises a base, a guide provided on the base to guide the movement through the oven of wagons bearing products to be treated in the oven, side walls connected to the base and a roof connected to the upper ends of the side walls in order to define a treatment chamber. At least one wagon usable with the oven comprises a base for supporting product to be treated, and wheels supporting the wagon base and engageable with the oven guide.

The base of the oven includes a pair of walls extending in the direction of movement of the wagons through the oven and arranged to define on the base a trough for containing liquid. The or each wagon which passes through the oven includes a depending skirt which is arranged to define an under chamber below the base of the wagon and which extends downwardly to such an extent that, when the trough contains liquid, a lower edge of the skirt is immersible in the liquid as the wagon moves through the oven in order substantially to seal-off the wagon under chamber from the oven treatment chamber and thereby allow the base of the wagon, or product carried by the base, effectively to define a lower face of the treatment chamber as the wagon moves through the oven.

The sealing-off of the under chamber, and the immersion of the lower edge of the skirt is achieved continuously throughout the travel of the wagon through the treatment chamber of the oven, despite the substantial pressure differences which can exist between a central region of the treatment chamber and inlet and outlet regions of the treatment chamber. A continuous liquid sealing joint is achieved around each wagon, via the engagement of the skirt in the liquid in the trough, as the wagon moves through the treatment chamber.

Figure 2:
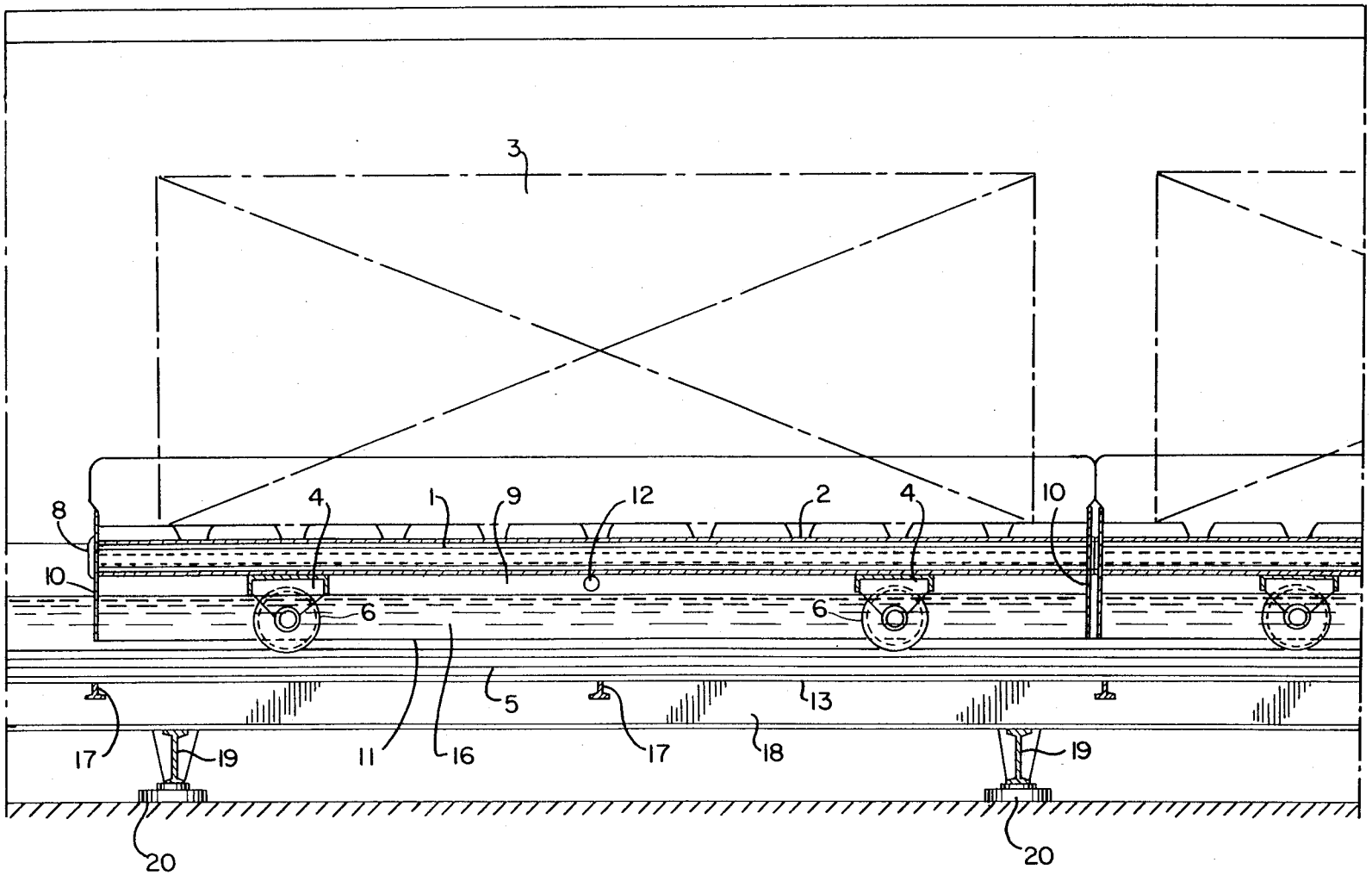
FIG. 2 is a schematic view in longitudinal cross section along the line II—II in FIG. 1.

Referring now to FIGS. 1 and 2, each wagon comprises a frame constituted essentially by two main beams 1, in the form of longitudinal I-shaped profiles, supporting a wagon base in the form of rectangular horizontal plate 2 on which are disposed insulating refractory linings, of any suitable type known per se, which will not be described but simply referenced as a whole, with the load of products to be fired or to be dried that they carry, by the reference number 3.

The main beams 1 are also integral with two pairs of bearing housings 4 in each of which a wheel is rotatably mounted, to allow the movements of the wagon on a guide on the base of the tunnel oven provided by rails 5. The two wheels 6, situated under the left main beam 1 in FIG. 1, are wheels with two flanges, whilst the wheels 7 situated under the other main beam 1 do not have any flanges, seeing that when the wagon is passing through the tunnel oven, its temperature varies and that it expands in all directions, notably transversely. As the wheels 7 do not have any flanges, they can move laterally to some extent when rolling longitudinally on the corresponding rail 5, so that the latter does not take any undue lateral forces.

In the middle of the transverse end faces of the wagon, the latter comprises thrust elements, for example thrust plates, for the transmission of thrust forces from one wagon to the other, and if desired coupling elements, the whole of these elements being integral with the framework, and being schematically represented at 8. On the side and transverse edges of the base plate 2 there are coupled and fixed, for example by welding, or in movable fashion by bolts, the upper parts, respectively of lateral sheet metal blades 9 and transverse sheet metal blades 10, taking the form of rectangular sheets depending vertically below the framework. The vertical edges of the sheet metal blades 9 and 10 are joined together in pairs, in definitive manner, by welding, for example, or in a moveable fashion by bolts so that the four sheet metal blades constitute a continuous depending shirt surrounding the frame of the wagon and defining a wagon underchamber below the base plate 2, and the lower edge 11 of which is at a level a little above the zone of contact of the wheels 6 and 7 with the rails 5. A vent hole 12 is pierced in the upper part of one lateral sheet metal blade 9 so as to connect the chamber defined under the plate 2 by the skirt of the sheet metal plates 9 and 10 with the volume defined between the tunnel oven and the wagon.

Throughout the tunnel oven the rails 5 extend along a horizontal lower wall 13 connected by two vertical walls 14 to two elevated horizontal walls 15 in such a way as to define a trough 16 of sufficient width to receive the wagons and containing a heat-carrying liquid, which can be water or an appropriate mineral oil. The volume of liquid contained in the trough 16 is such that for any position of the wagon in the tunnel oven, the lower edge 11 of the continuous skirt is constantly immersed in the liquid, whatever the level of the latter, which varies between a minimum level m and a maximum level M (see FIG. 1), taking into account differences in pressure which obtain between the central part, the hottest, of the tunnel oven, and the end parts, near the entrance (inlet region) or exit (outlet region) of the tunnel oven. The rails 5 of the path which crosses the tunnel oven at the bottom of the trough 16 with which the latter is equipped, are extended by inclined portions resting on an inclined ramp which allows, at the entrance of the oven, the descent of the wagons into the trough 16, and on an inclined ramp which allows, at the exit of the oven, the exit of the wagons from the trough 16. (These parts of the rails and of the trough are not shown).

With the exception of the entrance and the exit of the oven, there is thus obtained a continuous hydraulic sealing joint which surrounds the skirt of each wagon, the effect of which is to prevent any circulation of air or gas under the wagons, and hence the upward movement of this air or these gases between the transverse faces of two successive wagons or between the lateral faces of the wagons and the lateral walls of the oven, the vent hole 12 simply allowing the equilibrium of the pressures between the inside of the oven and the inside of the chamber defined under the plate 2 by the skirt of the sheet metal blades 9 and 10 and by the liquid.

The trough 16 of the tunnel oven with its liquid and the rails 5, the wagons received in the oven, and even the other elements constituting the oven are supported by a very strong carrier structure.

This comprises in particular I-shaped crosspieces 17 joined together between two longitudinal I-shaped beams 18 and disposed under the lower wall 13 of the trough 16 to support the latter, the liquid, the wagons and the rails which it receives. The beams 18, substantially under the rails 5, rest on the crosspieces 19 which themselves rest on the ground by means of height-adjustable feet 20, and supporting, at their ends situated outside the feet 20, longitudinal boxes 21 carrying on their upper face two longitudinal I-shaped beams 22 on which rest the elevated lateral walls 15 and the sealed lateral walls 23 of the tunnel oven, each constituted by a carrier frame 24, for example corrugated iron, and an insulating coating 25. The sealed roof 26 of the tunnel oven, also constituted by a carrier frame 17 of corrugated iron, and an insulating coating 28, is itself supported by the side walls 23.

The invention is not limited to the abovedescribed invention but also extends to embodiments that can be obtained by adapting existing materials, wagons and tunnel ovens, applying the technical measures of the invention to constitute a continuous hydraulic sealing joint around each wagon, thanks to a continuous skirt carried by the wagon and immersed constantly in the liquid contained in a trough formed in the oven, so as to prevent any circulation of air under the wagons.

It is also to be noted that in order to limit the evaporation of the water contained in the trough 16, in the cases where the water is used as a heat-carrying liquid, a layer of appropriate mineral oil can advantageously be poured on the surface of the water.

Generally the heat-carrying liquid can be constituted by a mixture of an association of several liquids of different nature.

Moreover, the trough 16 of the tunnel oven can be intentionally installed with a longitudinal slope and not a horizontal one. This slope can correspond to half the difference in the levels of the liquid, between the maximum level and the minimum level, in service, so that the bottom of the trough dips into the part of the oven where the greatest pressures obtain, so as to increase the margin of safety in keeping liquid that is necessary for the preservation of the continuity of the hydraulic joint surrounding each wagon.

Finally, the entrance and the exit of the wagons into and out of the trough 16 can be ensured by means of an elevator and a chute, of any suitable known type, instead of the inclined ramps mentioned above.

By simple means there can thus be obtained a very important result in the improvement of the performances of such tunnel ovens.

I claim:

1. A tunnel oven having a sealing arrangement for providing a substantially sealed closure of a lower face of a treatment chamber of said tunnel oven through which a train of wagons is movable in order to treat products carried thereby in said treatment chamber, said tunnel oven comprising:

a base having a longitudinally extending lower wall and two longitudinally extending elevated lateral walls, a travel path defined by two parallel rails extending longitudinally on said lower wall for guiding the movement of said wagons through said oven, two sealed lateral walls connected to said elevated lateral walls of said base, and a sealed roof connected to said sealed lateral walls, and each wagon of said train comprising:

a frame supported on wheels for rolling on said rails during movement of said wagon through said oven, a plate supported on said wagon frame and covered with insulating refractory linings for supporting said products to be treated, the wagon plates of said wagons of said train forming substantially said lower face of said treatment chamber defined between said wagon plates and said oven lateral walls and roof, during movement of said train through said oven, wherein said sealing arrangement comprises:

a pair of longitudinally extending and substantially upright walls of said oven base, each connecting said base lower wall to one of said base elevated lateral walls and defining therewith a trough containing a liquid, and, for each said wagon, an endless depending skirt comprising interconnected longitudinally extending and transversely extending metal blades extending downwardly from said wagon plate to such an extent that said skirt present a lower edge which is always immersed in the liquid contained in said trough as said wagon moves through said oven, in order to substantially seal-off a corresponding wagon under-chamber defined by said skirt below said wagon plate from said oven treatment chamber and thereby allow a substantially sealed closure of said lower face of said treatment chamber.

2. A tunnel oven comprising:

a base having a longitudinally extending lower wall and two longitudinally extending elevated lateral walls, two sealed lateral walls connected to said elevated lateral walls of said base, a sealed roof connected to said sealed lateral walls, and a travel path defined by two parallel rails extending longitudinally on said base lower wall for guiding through the oven the movement of at least a wagon carrying products to be treated in the oven, said wagon comprising:

a frame supported on wheels for rolling on said rails during movement of said wagon through said oven, a plate supported on said wagon frame and covered with insulating refractory linings for supporting said prouducts to be treated, said wagon plate forming at least partially a lower face of a treatment chamber defined in said tunnel oven between said oven lateral walls and roof and said wagon plate, and an endless depending skirt comprising interconnected longitudinally extending and transversely extending metal blades which extend downwardly from said wagon plate, said skirt presenting a lower edge situated a little distance above the level of contact of the wagon wheels with the oven rails and defining an under-chamber below said wagon plate, and wherein said oven base further includes a pair of longitudinally extending and substantially upright walls, each connecting said base lower face to one of said base elevated lateral walls and defining therewith a trough containing a liquid the level of which is such that said lower edge of said skirt is always immersed in said liquid as said wagon moves through said oven in order to substantially seal-off said wagon under-chamber from said oven treatment chamber and thereby allow a substantially sealed closure of said lower face of said treatment chamber.

3. A tunnel oven as in claim 2, wherein said liquid contained in said trough is at least one heat-carrying liquid of the group comprising water and mineral oil.

4. A tunnel oven as in claim 2, wherein said treatment chamber is located in a central treatment region of the oven which comprises also an inlet region and an outlet region and wherein said trough is arranged so that said liquid level is greatest in said central treatment region when said oven is not in operation.

5. A tunnel oven as in claim 2, wherein said trough and said oven sealed lateral walls are supported on a carrier structure.

6. A wagon for conveying products through a treatment chamber of a tunnel oven, said oven comprising:

a base having a longitudinally extending lower wall, two longitudinally extending elevated lateral walls, and two longitudinally extending and substantially upright walls, each connecting said lower wall to one of said elevated lateral walls and defining therewith a trough containing a liquid, a travel path defined by two parallel rails extending longitudinally on said lower wall for guiding the movement of the wagon through said oven, two sealed lateral walls connected to said elevated lateral walls of said base, and a sealed roof connected to said sealed lateral walls, said wagon comprising:

a frame supported on wheels for rolling on said rails during movement of said wagon through said oven, a plate supported on said wagon frame and covered with insulating refractory linings for supporting said products to be treated, said wagon plate forming at least partially a lower face of said treatment chamber defined in said tunnel oven between said oven lateral walls and roof and said wagon plate, wherein said wagon further comprises:

an endless depending skirt including interconnected longitudinally extending and transversely extending metal plates which extend downwardly from said wagon plate to such an extent that said skirt presents a lower edge which is always immersed in said liquid contained in said trough as said wagon moves through said oven, in order to substantially seal-off a wagon under-chamber defined by said skirt below said wagon plate from said oven treatment chamber and thereby allow a substantially sealed closure of said lower face of said treatment chamber.

7. A wagon as in claim 6, wherein a vent hole is formed in said skirt above the maximum level of said liquid with respect to said skirt to provide a communication allowing pressure equalization between said wagon under-chamber and said oven treatment chamber.

8. A wagon as in claim 6, wherein said wagon frame and said wagon plate have longitudinally extending side walls and transversely extending end walls to which are fixed respectively said longitudinally extending and transversely extending metal blades of said skirt.

* * * * *